United States Patent [19]

Palmans

[11] Patent Number: 4,487,586

[45] Date of Patent: Dec. 11, 1984

[54] FRAMED BOARD WITH WRITING SURFACE

[75] Inventor: Jos Palmans, Sint-Huibrechts-Lille, Belgium

[73] Assignee: Alliance Europe S.A., Belgium

[21] Appl. No.: 440,948

[22] Filed: Nov. 12, 1982

[30] Foreign Application Priority Data

Dec. 16, 1981 [LU] Luxembourg ..... 83839

[51] Int. Cl.[3] ..... A47G 1/06

[52] U.S. Cl. ..... 434/408; 40/154

[58] Field of Search ..... 40/152, 154; 434/421, 434/422, 423, 424, 425

[56] References Cited

U.S. PATENT DOCUMENTS

| | | | |
|---|---|---|---|
| 485,802 | 11/1892 | Kohler | 434/424 |
| 2,186,643 | 1/1940 | Kaplan | 40/154 |
| 3,150,457 | 9/1964 | Thieme | 40/152 |
| 3,235,990 | 2/1966 | Back | 40/152 |
| 3,363,341 | 1/1968 | Glassman | 434/421 |
| 3,523,382 | 8/1970 | Dreyer | 40/152 |

*Primary Examiner*—Harland S. Skogquist

*Attorney, Agent, or Firm*—Darby & Darby

[57] ABSTRACT

A board intended to be used as a writing surface is provided with a frame and with a complementary border constituting one inseparable entity. The frame is continuous all around the periphery with a cross-section comprising three flanges. One flange is external to the other two, a second flange is equipped with a rim positioned behind the board and bearing against a foot formed on the complementary border, and the third flange bears against the front face of the board.

6 Claims, 7 Drawing Figures

FRAMED BOARD WITH WRITING SURFACE

BACKGROUND OF THE DISCLOSURE

This invention relates to a board, or an assembly of boards, each equipped with a frame and intended for use as a writing surface. If it is of the enameled metal type, it may also be intended for magnetized objects or objects comprising a magnet to be attached to it. By means of such magnet, nonmagnetized objects such as for instance sheets of paper may also be held fast to the board.

Various conventional framed boards are capable of being used flat. In particular, they can be placed on a wall where they fulfill the functions indicated; in such embodiments there may be a frame composed of several elements which are fitted onto the edge of the board and which are subsequently joined in various ways, for example by gluing or other adhesive means or by a joinling method which makes use of a certain number of subsidiary components such as nails, screws, brackets etc. Alternatively the board may be fitted from behind into a single-piece frame, the latter possessing in this case a shoulder against which the board is held by means of a certain number of subsidiary components such as chocks, nails, screws, etc.

SUMMARY OF THE INVENTION

To realize a framed board according to this invention, use is not made of any kind of gluing or of subsidiary fixing pieces, but the board is simply inserted from the rear into the frame. The frame alone may hold and grip the edge of the board, or the frame may hold and grip the edge of the board jointly with a border which is introduced from the rear into the frame to form one inseparable entity.

For this purpose, the framed board according to this invention is characterized in that the frame is continuous around its periphery and has a profile or section which possesses three arms or flanges of which two of the flanges are at an angle to each other. One of these flanges, or an extension of it, serves as support for one face of the board. The other flange is equipped, towards the inside, with a projecting rim capable of bearing directly on the other face of the board or on the foot of a complementary border. Such complementary border bears on the other face of the board. At least to some extent, one of the flanges of the frame possesses a certain elasticity so that the frame, after the board has been inserted into it, tightens onto the board.

The fact that the board is tightly gripped in the frame is particularly advantageous, because in effect it is thereby prevented from sliding within the frame.

The framed board according to this invention comprises a rear, complementary border. The complementary border, like the rear face of the frame, is formed in such a manner that it is capable of satisfying, for example, the following criteria: it can be hung on a wall, this being possible any side up when it is rectangular; it can be used flat, for instance on a table; various devices can be attached to it, for example a box, a hook, etc., for holding and positioning for instance, a marker, a duster or cloth, etc.; a hinge may be fitted to it, permitting a first board to have a second board attached to it and to form a diptych, or, with a third board, a triptych.

Preferably, the framed board according to this invention is constructed so as to satisfy not merely one but all of the criteria indicated above.

BRIEF DESCRIPTION OF THE DRAWING

To assist in a better understanding of the invention and to illustrate its advantages and characteristics, it is now described in the context of an example in relation to the appended drawing, wherein.

Figure 3:
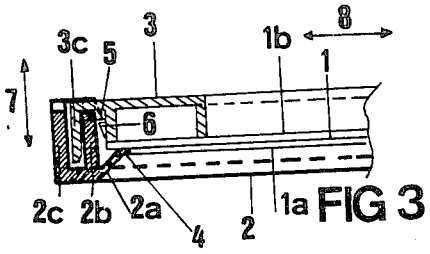
FIG. 3 is a partial sectional view along the line A—A of FIG. 2.
Figure 3A:
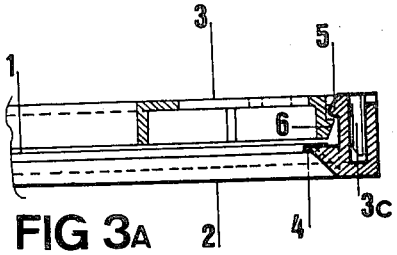
FIG. 3*a* is a partial sectional view along the line A'—A' of FIG. 2.
Figure 4:
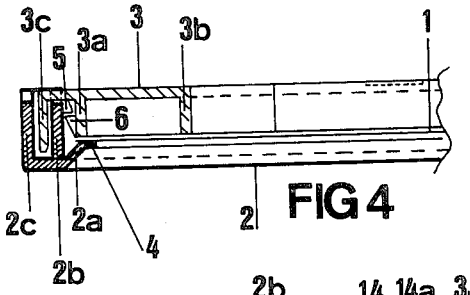
FIG. 4 is a partial sectional view along the line B—B of FIG. 2.
Figure 4A:
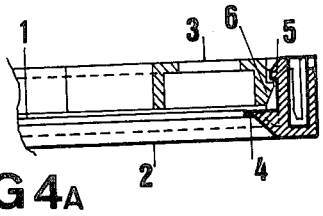
FIG. 4*a* is a partial sectional view along the line B'—B' of FIG. 2.
Figure 5:
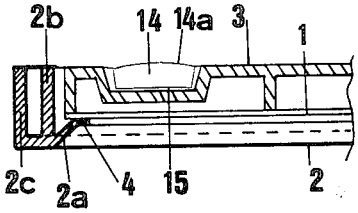
FIG. 5 is a partial sectional view along the line C—C of FIG. 2.

Referring to these various figures, reference 1 denotes the board proper, a rigid enameled metal plate or other writing surface, and reference 2 the frame, which is visible at the side of the front face 1A and rear face 1B of the board 1. Reference 3 denotes the complementary border, which is visible only at the rear face 1B of the board 1.

The frame 2 comprises, as can be seen in profile (FIGS. 3, 3*a*, 4, 4*a*) at least two arms or flanges 2A, 2B disposed at an angle relative to each other. One arm or flange 2A is equipped with an extension 4 that serves as support for the face 1A of the board. The other arm or extension is equipped with a rim 5 which projects towards the inside to hold the other face 1B of the board beneath a foot 6 with which the complementary border 3 is equipped (FIGS. 3, 3*a*, 4, 4*a*). The complementary border 3 bears in this case against the face 1B of the board 1.

For the board 1 to be able to be inserted in the frame 2 and in this case where a complementary border 3 is provided and where the foot 6 of the latter should engage beneath the rim 5 of the frame and then be tightly clamped there, it is necessary to arrange for a certain play in the two directions more or less perpendicular to the board 1 (see arrow 7), and also in those two directions more or less in the extension of the edge of the board 1 (see arrow 8). This can be accompanied by providing for a certain elasticity of at least some parts of thr frame 2 and/or possibly a certain part of the complementary border 3, if the border 3 is employed.

In order to insert the board 1 and/or the complementary border 3, a certain elasticity and clearance must be provided. It is important, on the other hand, to ensure that after this insertion there is a sufficiently strong restoring force for the board 1 to be securely gripped or clamped. Thus, before insertion of the board the portion of the frame 2 which bears on the front face 1A of the board should be separated from the portion of the frame 2 or of the complementary border 3 which bears on the rear face 1B of the board by a distance which is at least slightly less than the thickness of the board 1.

In view of the fact that the frame 2 is of material possessing a certain elasticity, that is to say is not in fact sufficiently rigid, it is provided that the frame 2 comprises in its profile an external, complementary flange 2C, and the complementary border 3 is of a U-section. That is, the border 3 is formed with two flanges 3A, 3B, of which the complementary flange 3B has essentially the purpose of providing rigidity to the complementary border 3.

In the embodiment shown in FIGS. 2–5, these complementary flanges 2C and 3B are found both in the profile of the frame 2 and in that of the complementary border 3. These two components 2 and 3 are so designed as to assure perfect fixing of the board 1, that is to say to grip it completely and to form an inseparable entity, but having regard also to other considerations of use.

Figure 1:
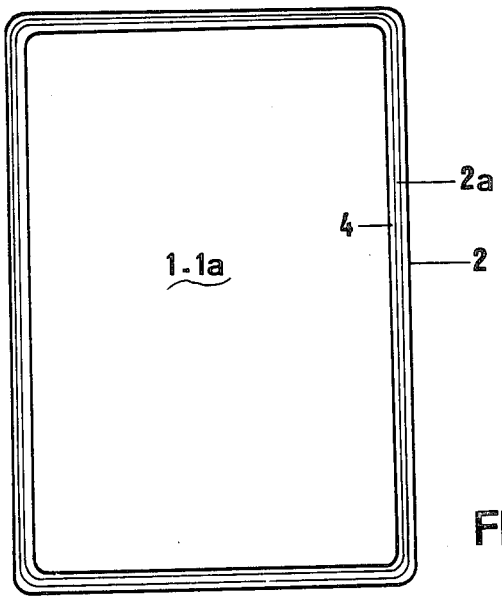
FIG. 1 is a schematic view of the front face (working face) of a framed board according to the invention.

Thus, the frame 2 (FIGS. 2–5) comprises three flanges, of which one (2A) is inclined relative to the other two (2B, 2C) and ends in an extension 4 parallel to the external surface 1A of the board 1; this extension 4 forms a small rim serving as a stop when a marker is used and thus protects the frame (FIG. 1). The other two flanges 2B, 2C are parallel to each other and are braced together at a certain number of positions along the perimeter of the frame (2), which increases the rigidity of the frame. The bracings 9 (see FIG. 2) define a series of cells 10. The complementary border 3 (FIGS. 2–5), of U-section, comprises two parallel flanges (3A, 3B) fairly widely spaced from each other, so as to provide at the rear of the board a fairly wide peripheral strip 11 (FIG. 2), in which eyes 12 can be formed, into which hooking means (not shown) may be slid.

To complete the rigidity of the complementary border 3 and assure its correct insertion in the frame 2 feet 13 are provided (FIG. 2) at certain intervals along its external perimeter. The feet 13 are formed of a third flange 3C parallel to the other two flanges 3A, 3B of the border 3. The third flanges 3C will each slide into one cell 10, that is to say between the flanges 2C and 2B of the frame (see FIGS. 3 and 4), in such a manner that the complementary border 3 and the frame 2 constitute one solid assembly capable of withstanding high operational stresses. As can be clearly seen in FIG. 2, a certain number of cells 10 are kept empty. This makes it possible to introduce therein the foot or lug (not shown) or, more generally, a group, for example three in number, of aligned feet or lugs, of the hooking means oi an accessory device or indeed of a hinge, permitting the attachment to the first framed board of a second (not shown).

At the four corners of the complementary border 3, buffers 14 (FIGS. 2 and 5) of elastic material are positioned and fixed (for example glued) in a complemental housing means or cavity 15 provided in the complementary border 3. These buffers 14, which are slightly convex on their external faces 14*a* (FIG. 5), serve as bearing points for the framed board and prevent it from scratching the surface on which it is used. They also prevent sliding if it is used flat, for example on a table, without being secured.

Furthermore, these elastic buffers 14 project slightly beyond the rear plane of the framed board and in this way keep it perfectly in position when it is hung by two points (using two eyes 12) from a wall.

These buffers 14 may, of course, be of a different form and structure from that shown and, for example, they can be small rubber studs with attached conical feet.

Figure 2:
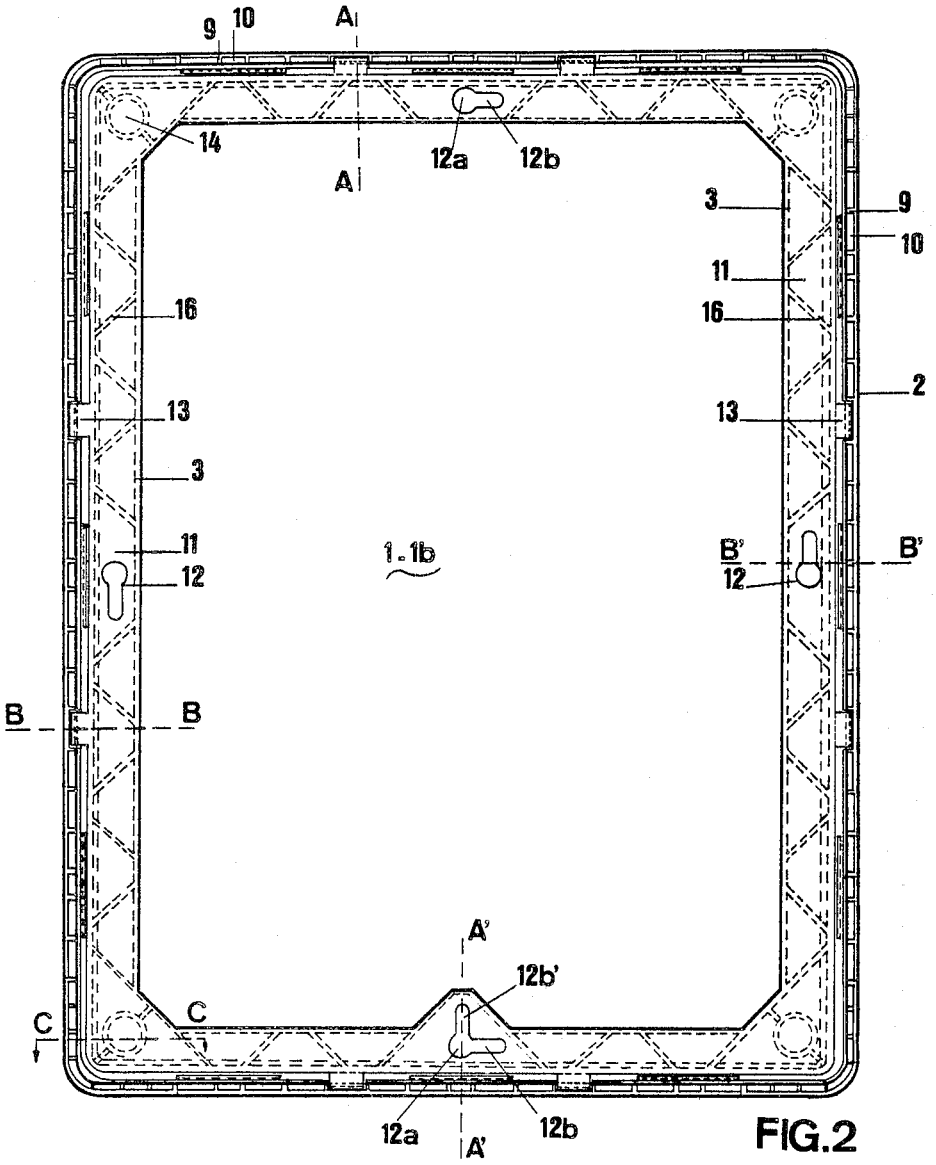
FIG. 2 is a view of the rear face (resting and hanging face) of one embodiment of a framed board in accordance with the invention.

Preferably, as can be seen in FIG. 2, the eyes 12 are of elongated form and equipped with a round aperture 12A forming an enlarged zone through which the head of the suspension means (for example a screw) can be introduced, this head then being slid along the extended, narrow part 12B of the eye by lowering the framed board.

To assure good stability, there have been provided not merely one eye 12 providing a point of suspension at the upper, horizontal part of the framed board, but two eyes 12 at mid-height of the vertical sides of the framed board and therefore two points of suspension. If this board, as shown, is rectangular, one eye 12 is provided at each side, so that the framed board can be suspended either in the direction of its length or in the direction of its width.

In the case of a triptych or more particularly in the case of a diptych, the framed board, which is hooked onto the wall and on which a second board is mounted by hinges, has a third point of suspension: In addition to the two eyes 12 of the longitudinal sides, a third eye 12 on the lower side is also placed in service. To achieve this, as can be seen, the eye 12 which is provided there comprises a second narrower portion 12B′ extending in the vertical direction.

As FIG. 2 shows in dotted outline, to reinforce the complementary border 3, the two flanges 3A, 3B are connected together by transverse braces 16.

A certain number of elements are thus provided to increase the stiffness of the frame 2 and of the complementary border 3. These elements include the flanges 2A, 2C and 3A, 3B and bracings 9 and 16, etc. By contrast, in order to permit the insertion of the complementary border 3 in the frame 2 a thinning down of the flange 2*a* is provided at certain locations of the perimeter and not at others, and the projecting rim 5 and the foot 6 are provided at some but not all locations around the perimeter.

The invention is not limited to the embodiment described and represented. For example, an adhesive strip (not shown) may be glued to the strip 11 of the complementary border 3. Such an adhesive strip permits fixing of the framed board to a wall. For aesthetic reasons, as FIGS. 1 and 2 show, the four corners of the rectangular frame 2 are rounded, though this does not mean that the rounding must apply to the board 1 itself. Of course, the board 1 and frame 2 may have any desired shape.

I claim:

1. Apparatus comprising a board, a frame for said board, and a complementary border forming an inseparable entity with said board and frame, said board being intended to be used as writing surface, said frame being continuous all around the periphery of said board and being formed with at least two flanges disposed at an angle relative to each other, one of said flanges supporting one face of the board and the other flange being formed with an inwardly projecting rim, the complementary border having a U-section including two arms which bear against the other face of the board, one of said arms being formed with an outwardly projecting foot, said rim engaging said foot to lock said border to said frame, at least one of the flanges providing elasticity, so that the frame, after the board has been inserted therein, grips the board securely.

2. Apparatus according to claim 1 characterized in that one of said flanges is formed with an extension parallel to the external surface of the board and forms a stop for it, further comprising a third flange formed on said frame, said third flange being parallel to the other of said two flanges, and a plurality of braces at spaced-apart locations around the perimeter of the frame defining a plurality of cells.

3. Apparatus according to claim 2 characterized in that the complementary border comprises, at spaced-apart locations around its external perimeter, a plurality of feet respectively insertable into said cells.

4. Apparatus according to any one of claims 1–3 characterized in that said arms are spaced apart one from the other to define therebetween a peripheral strip, further comprising means operatively associated with said strip for attaching the board to a wall.

5. Apparatus according to claim 4 further comprising housing means formed at spaced-apart locations of the strip and elastic buffers mounted in said housing means.

6. Apparatus according to claim 3 characterized in that the number of said cells exceeds the number of said feet, whereby at least some of said cells can accommodate hinge means for connecting said apparatus to additional such apparatus.

* * * * *